US006276143B1

(12) United States Patent
Wimberley

(10) Patent No.: US 6,276,143 B1
(45) Date of Patent: Aug. 21, 2001

(54) EXTERNAL PRESSURE BUILDING CIRCUIT FOR RAPID DISCHARGE CRYOGENIC LIQUID CYLINDER

(75) Inventor: John S. Wimberley, Mobile, AL (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 09/484,092

(22) Filed: Jan. 18, 2000

(51) Int. Cl.[7] ..... F17C 9/02
(52) U.S. Cl. ..... 62/50.2
(58) Field of Search ..... 62/45.1, 48.1, 62/50.2

(56) References Cited

U.S. PATENT DOCUMENTS

| | | | | |
|---|---|---|---|---|
| 1,872,831 | | 8/1932 | Siems . | |
| 1,930,731 | * | 10/1933 | Thompson | 62/50.2 |
| 2,576,985 | | 12/1951 | Wildhack . | |
| 3,293,871 | * | 12/1966 | Tyree | 62/50.2 |
| 4,174,619 | | 11/1979 | Tocha . | |
| 4,399,660 | * | 8/1983 | Vogler et al. | 62/50.2 |
| 4,598,554 | * | 7/1986 | Bastian | 62/50.2 |
| 5,251,452 | * | 10/1993 | Wieder | 62/50.2 |
| 5,357,758 | | 10/1994 | Andonian . | |
| 5,761,911 | | 6/1998 | Jurcik et al. . | |
| 6,000,226 | * | 12/1999 | Lee et al. | 62/48.1 |

* cited by examiner

*Primary Examiner*—William Doerrler
(74) *Attorney, Agent, or Firm*—David C. Jenkins; Eckert Seamans Cherin & Mellott, LLC

(57) ABSTRACT

An external pressure building circuit for a portable cryogenic liquid cylinder which includes a tubular member disposed outside of the cylinder. The tubular member has an upper portion and a lower portion. The upper portion of the tubular member is in communication with the gas containing portion of the cryogenic liquid cylinder; the lower portion is in communication with the liquid containing portion of the cryogenic liquid cylinder. The tubular member between about 30 and 60 inches long and includes a plurality of fins attached to the tubular member. The fins act as a heat transfer device. In operation a quantity of cryogenic liquid enters the lower portion of the tubular member and is heated. Once the liquid is converted to a gas, it is returned to the gas containing portion of the cylinder. By converting a sufficient quantity of cryogenic liquid to gas, a pressure of greater than 400 p.s.i. can be maintained at a high continuous rate of flow, e.g., greater than 2000 cfh.

26 Claims, 3 Drawing Sheets

EXTERNAL PRESSURE BUILDING CIRCUIT FOR RAPID DISCHARGE CRYOGENIC LIQUID CYLINDER

BACKGROUND OF THE INVENTION

1. Field of the Invention

This invention relates to a cryogenic liquid cylinder and, more specifically, to a cryogenic liquid cylinder having a vertical external pressure building circuit.

2. Description of the Prior Art

Industrial applications, such as laser cutting, often require a large volume of certain gases. To transport such gases to a remote location, cryogenic liquid cylinders are used. When a gas is converted into a cryogenic liquid, a great quantity may be stored in a reduced volume and at a lower pressure compared to the volume and pressure required to store the substance as a compressed gas. Cryogenic liquid cylinders are well insulated and, as a result, the cryogenic liquid does not evaporate quickly while being stored. This can be a drawback, as many industrial applications require a high volume of gas at or near ambient temperature. Accordingly, cryogenic cylinders often include a means to enhance the conversion of the cryogenic liquid into a gas.

To convert a cryogenic liquid to a gas, a cryogenic cylinder is typically equipped with both a pressure building circuit and a vaporizer circuit. Both circuits drain liquid from the lower portion of the container and deliver the liquid to a tubular member which is less insulated than the cryogenic liquid chamber. Because the tubular member is less insulated, the cryogenic liquid's temperature in the tubular member is raised above its boiling point and the liquid is converted into a gas. In the pressure building circuit, the gas is returned to the upper portion of the container. This gas increases the pressure in the container. Gas from a vaporizer circuit is channeled directly to an end application. Once the pressure building circuit provides the desired gas pressure, gas may then be channeled from the cylinder through the vaporizer circuit to the end application. In applications such as laser cutting, the pressure in the cylinder must be maintained above 400 p.s.i. during high continuous flow (>2000 cfh).

Cryogenic liquid cylinders typically have an outer shell or container and an inner container. A vacuum is maintained between the inner and outer container to help insulate the inner container where the cryogenic liquid is stored. Additional insulation may be provided through alternate layers of paper and aluminum foil to reduce heat transfer through conduction and radiation. Presently, pressure building circuits are disposed in the plenum between the inner and outer containers. This location protects the pressure building circuit within the outer container. The pressure building circuit consists of a tube connected at one end to a lower opening through the lower portion of the inner container, and at the other end to an upper opening through the upper portion of the inner container. This allows a quantity of cryogenic liquid to enter the pressure building circuit through the lower opening, whereupon the liquid head, i.e., the pressure created by the higher level of liquid in the container, will force the cryogenic liquid upwards through the pressure building circuit. As the cryogenic liquid passes through the circuit, its temperature is raised until it boils thereby becoming a gas. The gas then passes through the upper opening back into the inner container.

While being located within the outer container protects the pressure building circuit, the location of has several disadvantages that prevent such containers from providing high pressure at continuous flow (e.g. 400 p.s.i. at a flow rate >2000 cfh) and a relatively warm (within 20° F. of ambient) gas. For example, because of the limited space between the inner and outer containers, a typical pressure building circuit consists of ¼–¾ inch copper tubing wrapped about the internal container. The tube contacts the outer container and is heated by conduction. This heat transfer provides the energy to convert the cryogenic liquid to a gas. However, because only one side of the tube contacts the outer container, and because the tube may also contact the inner container, the rate of heat transfer is lower than can be achieved with an external pressure building circuit. When the rate of heat transfer is low, the conversion of cryogenic liquid into gas is slow. Additionally, when the rate of heat transfer is low, the temperature of the resulting gas may not rise far above the temperature of the cryogenic liquid.

An internal pressure building circuit has another disadvantage caused by the construction of most cryogenic liquid cylinders. Current welding methods used with cryogenic containers prevent the lower opening to the inner container from being adjacent to the bottom of the container. Additionally, the pressure building circuit will extend upwards to a point approximately 8 inches above the bottom of the inner cylinder. Because the level of liquid in the cylinder must be several inches above the lower opening to provide a sufficient liquid head to force the cryogenic liquid through the pressure building circuit, the pressure building circuit will stop working when the level of cryogenic liquid drops close to the level of the top of the pressure building circuit, is approximately 8 inches above the bottom of the inner cylinder. This is a disadvantage because, when the lower opening is several inches above the bottom of the inner container, a significant quantity of cryogenic liquid remains in the tank after the pressure building circuit loses its functionality.

External pressure building circuits have been used in the past, see e.g. Wildhack, U.S. Pat. No. 2,576,985. However, such external pressure building circuits have some structural similarities to internal pressure building circuits, e.g. a long tubular member wrapped around the cylinder, and similar limitations, e.g. a maximum pressure of 50 p.s.i. See Wildhack FIGS. 7–9 and col. 3, lines 71–73. Additionally, prior art external pressure building circuits used long, narrow tubular members. See e.g. Wildhack at col. 4, lines 24–25, noting a coil length of 80 feet with an inner diameter of ⅝ inch. Wildhack also discusses a high pressure charging converter, see Wildhack cols. 7–8, lines 60–42, but notes that despite an operating pressure of 2000 p.s.i., the flow rate is approximately 48 cu. in./min. and such a gas would not be at or near ambient temperature.

Therefore, there is a need for a pressure building circuit that is capable of maintaining a high pressure during high continuous flow.

There is a further need for a pressure building circuit that is protected from damage.

There is a further need for a pressure building circuit that enables use of substantially all of the cryogenic liquid contained in a cryogenic cylinder.

There is a further need for a pressure building circuit that can fit in a confined space.

There is a further need for a pressure building circuit that can be attached to a portable cryogenic liquid cylinder.

SUMMARY OF THE INVENTION

The present invention satisfies the above referenced needs by providing a cryogenic liquid cylinder having a vertical external pressure building circuit. The cylinder is portable and may be attached to a pallet. Preferably, the vertical external pressure building circuit includes at least one fin, and preferably a plurality of fins, to aid in heat transfer. The internal diameter of the tube adjacent to the fins is preferably between about ¾ and 1½ inches, allowing a greater volume of cryogenic liquid to be heated. Finally, the vertical external pressure building circuit is coupled to the inner container through a bottom tap, allowing substantially all of the cryogenic liquid to be used. To prevent the cryogenic cylinder from tipping over and damaging the external pressure building circuit, the cylinder is attached to a base support such as a pallet. The pallet preferably has a surface area 50% larger than the cross-sectional area of the cylinder. The external pressure building circuit, preferably, does not extend over the edge of the pallet; thus the pallet also provides a guard against damage when moving the cylinder.

It is an object of this invention to provide a cryogenic liquid cylinder capable of maintaining a high pressure during high continuous flow of gas.

It is a further object of this invention to provide a cryogenic liquid cylinder having an external pressure building circuit.

It is a further object of this invention to provide a portable cryogenic liquid cylinder having an external pressure building circuit.

It is a further object of this invention to provide a means of protecting an external pressure building circuit on a cryogenic liquid cylinder from damage.

It is a further object of this invention to provide a cryogenic liquid cylinder having an external pressure building circuit which is compatible with current equipment which fills such cylinders with a cryogenic liquid.

It is a further object of this invention to provide a cryogenic liquid cylinder having an external pressure building circuit which is compatible with current equipment which use gas that is stored as a cryogenic liquid.

An understanding of the invention can be gained from the following description of the preferred embodiment when read in conjunction with the accompanying drawings.

DESCRIPTION OF THE PREFERRED EMBODIMENT

Figure 1:
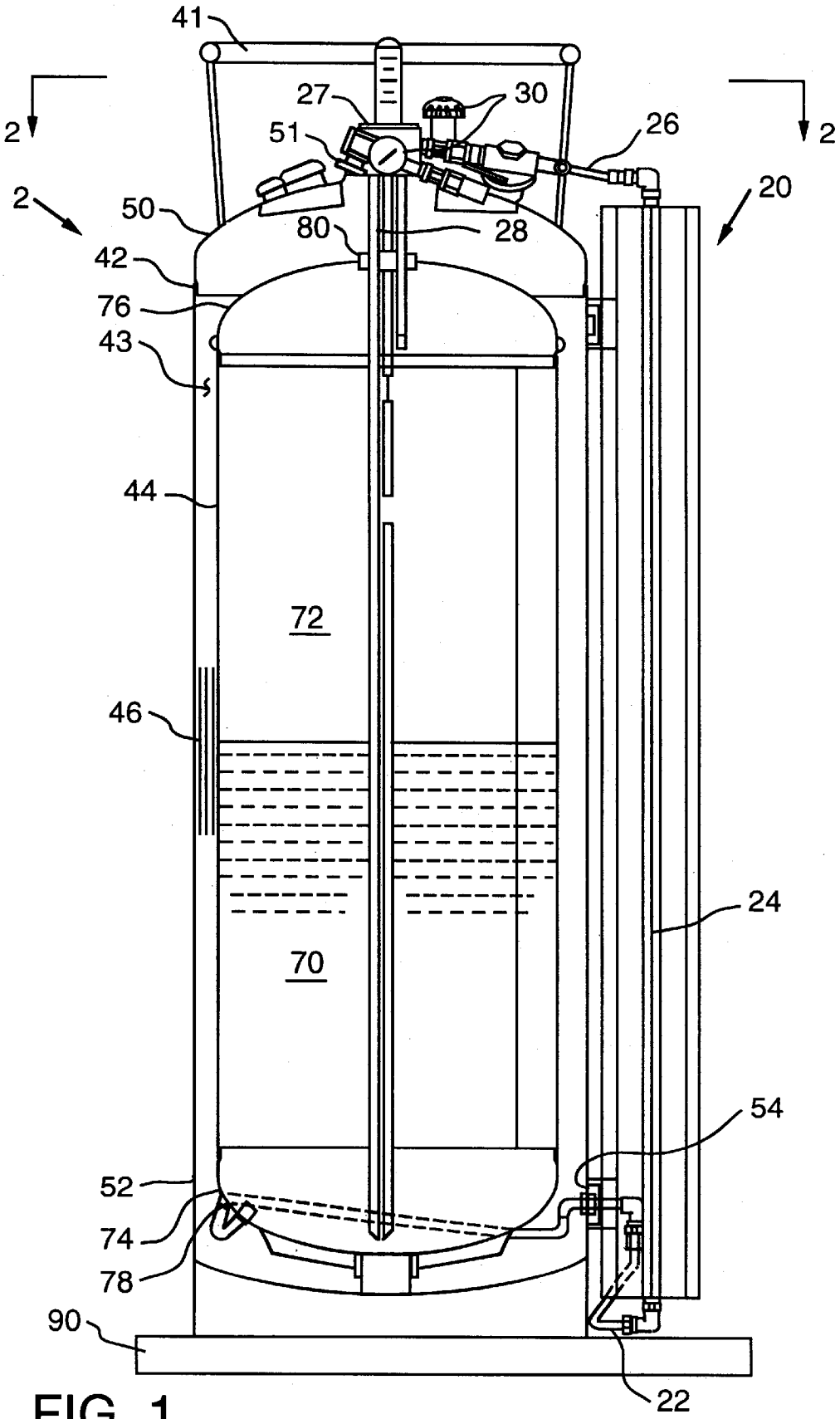
FIG. 1 is a partial cross-sectional elevational view of a cryogenic liquid cylinder having an external pressure building circuit.

A portable cryogenic cylinder 2 with an external pressure building circuit 20 is shown in FIG. 1 according to the present invention. The pressure building circuit 20 is coupled to a cryogenic liquid cylinder 2 to permit fluid flow therebetween. The cryogenic liquid cylinder includes a cylindrical outer container 42 and a cylindrical inner container 44. The outer container 42 and inner container 44 can be made from materials such as nickel-steel alloys and/or aluminum, but are preferably made from stainless steel. Both the outer container 42 and the inner container 44 are sealed from the environment, as well as being sealed from each other. A lifting means, such as a handle 41 may be coupled with the outer container 42.

Preferably, an insulation means, such as a vacuum 43, and may include alternate insulation means such as layers of aluminum foil and paper 46, exists between the outer and inner container 42, 44. The outer container 42 has an upper portion 50 and a lower portion 52. The lower portion 52 is attached to base member such as a pallet 90. The upper portion 50 has an upper opening 51 passing therethrough. Additionally, outer container 42 has a lower opening 54 passing therethrough adjacent to the lower portion 52.

The inner container 44 holds a cryogenic liquid in a cryogenic liquid containing portion 70. Above the cryogenic liquid containing portion 70 of the inner container 44 is a gas containing portion 72. The inner container 44 also has a lower portion 74 and an upper portion 76. A bottom tap 78 is located on lower portion 74 of the inner container 44 and a top tap 80, coupled to a necktube 28 and a top manifold 27, is located on upper portion 76 of the inner container.

The external pressure building circuit 20 is coupled to both the bottom tap 78 and the top tap 80 to allow fluid to flow from the inner container 44 into the external pressure building circuit 20 and gas to flow from external pressure building circuit 20 into inner container 44. The external pressure building circuit 20 includes a lower tubular member 22, a generally vertical tubular member 24, and an upper tubular member 26. The tubular members 22, 24, and 26 are in fluid communication. Additionally, the lower tubular member 22 is in fluid communication with the bottom tap 78 and the upper tubular member 26 is in fluid communication with top manifold 27 which further communicates with neck tube 28. One end of the lower tubular member 22 is coupled with the bottom tap 78. The lower tubular member 22 extends through the outer container lower opening 54. The other end of the lower tubular member 22 is coupled with the generally vertical tubular member 24. The generally vertical tubular member 24 extends generally vertically and generally parallel to the liquid cylinder 2. The generally vertical tubular member 24 preferably has an inner diameter between about ¾ and 1½ inches. The generally vertical tubular member 24 is preferably between about 30 and 60 inches long. The generally vertical tubular member 24 is coupled at its other end to the upper tubular member 26. The upper tubular member 26 is also coupled through the top manifold 27 to neck tube 28. Neck tube 28 passes through upper opening 51 and is coupled to the top tap 80 of inner chamber 44. The neck tube 28 may have a plurality of valves 30 to selectively direct the flow of gas from the external pressure building circuit 20 and to an external application (not shown) or to inner container 44. The combined length of the lower tubular member 22, vertical tubular member 24, and upper tubular member 26 is preferably between about 45 and 90 inches.

Figure 2:
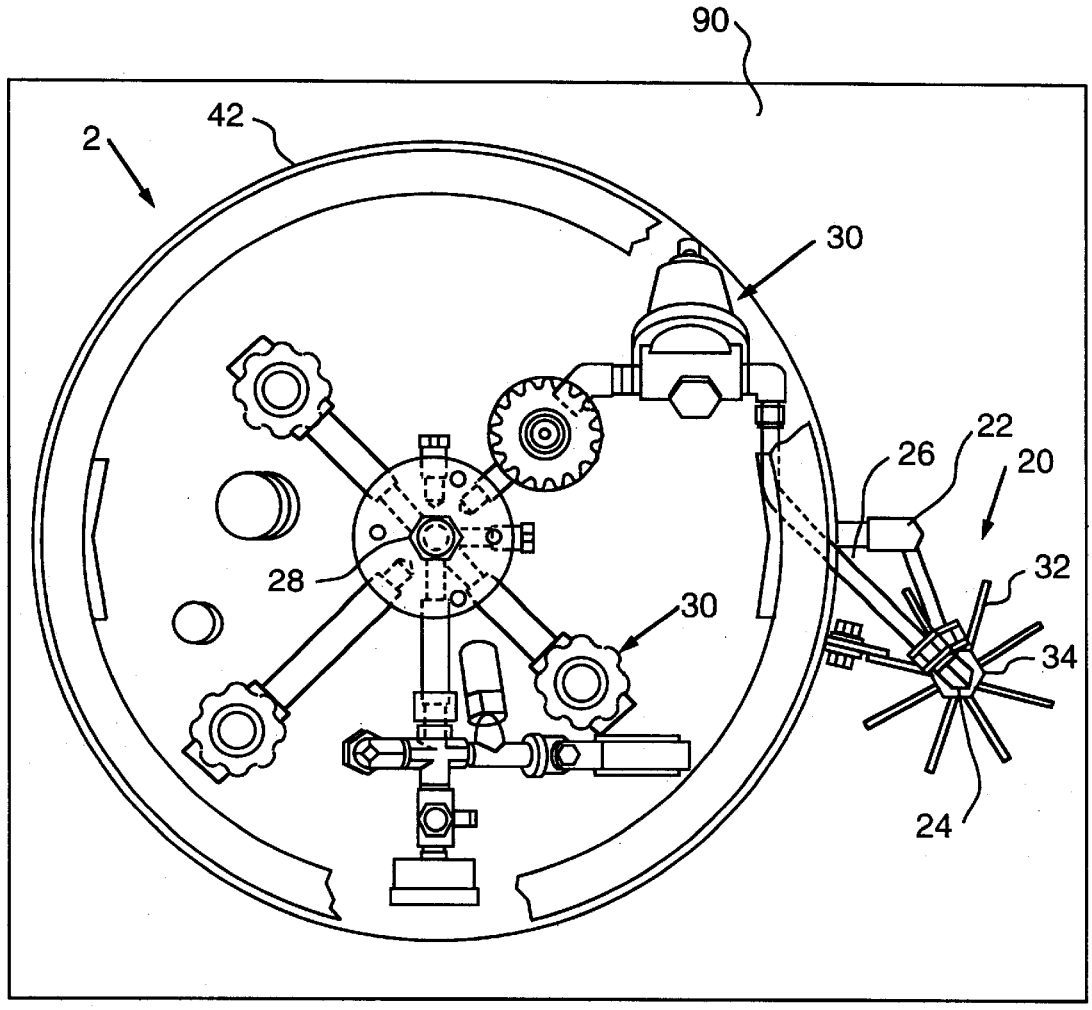
FIG. 2 is a cross-sectional top view taken along line 2—2 of FIG. 1.

In the preferred embodiment, as shown on FIG. 2, the generally vertical tubular member 24 has a plurality of fins 32 projecting generally radially outwardly and extending along substantially all of the outer surface 34 of the generally vertical tubular member 24. In a more preferred embodiment, the fins 32 are evenly spaced around the vertical tubular member 24. The fins 32 are coupled with the outer surface 34 of the vertical tubular member 24 and act as a heat transfer means. The fins 32 are, preferably, between about one and five inches wide. The fins 32 may be made from a non-ferrous metal, but are preferably made from aluminum.

The cryogenic cylinder 2 is portable. To inhibit the cylinder 2 from tipping over, it is attached to a base member such as a pallet 90. The pallet 90 preferably has a surface area about 50% greater than the cross-sectional area of the cylinder 2. The pallet 90 may be made from carbon steel or stainless steel and may be adapted to be transported by a forklift or other means commonly known in the art. The external pressure building circuit 20 is disposed entirely above the pallet 90, therefore, when the cylinder 2 is moved, the pallet 90 inhibits the external pressure building circuit 20 from being moved horizontally into other objects. For additional protection, a frame (not shown) which encloses the cylinder 2 and external pressure building circuit 20 can be attached to the pallet 90.

Figure 3:
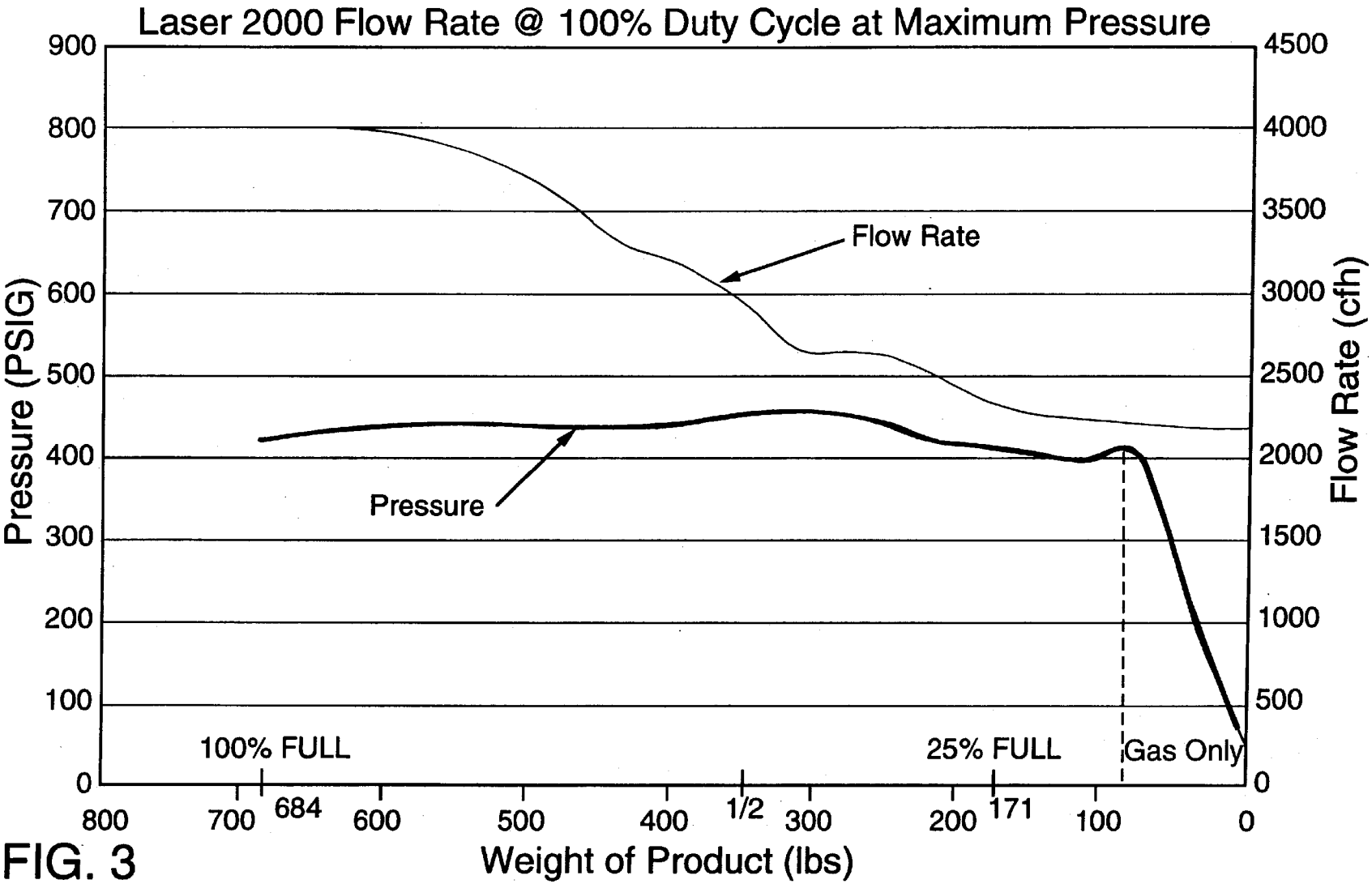
FIG. 3 is a graph showing the flow rate of a gas compared to the internal pressure of a cryogenic liquid cylinder having an external pressure building circuit.

As shown on FIG. 3, the superior performance of an external pressure building circuit 20 allows a portable cryogenic liquid cylinder 2 to maintain a pressure of greater than 400 p.s.i. at a flow rate above 2000 cfh. On the graph, the left vertical axis represents the gage pressure of the cylinder, the right vertical axis represents the flow rate of the gas, these values are plotted against the amount of cryogenic liquid and gas remaining in the tank which is represented as a weight shown on the horizontal axis. As is shown, the pressure is maintained above 400 p.s.i. until the cylinder 2 is more than 85% empty of total product. Additionally, the flow rate remains above 2000 cfh. In this example a 450 liter tank was filled with 684 pounds of nitrogen. The ambient temperature was 85°. Using the external pressure building circuit 20, a sufficient supply of nitrogen gas was provided to support a laser cutting operation. Additionally, because the cryogenic liquid cylinder was equipped with a bottom tap 78, 90–100% of the cryogenic liquid was utilized prior to the external pressure building circuit 20 losing its effectiveness.

Accordingly, this invention provides a cryogenic liquid cylinder 2 capable of providing a gas at high pressure, e.g. above 400 p.s.i., during a high continuous flow, e.g. >2000 cfh. This is accomplished by coupling the cryogenic fluid containing inner container 44 to an external pressure building circuit 20 which includes a generally vertical tubular member 24 having a length between 30 and 60 inches and an internal diameter between ¾ and 1½ inches. The generally vertical tubular member 24 is coupled to a plurality of fins 32 which act as heat transfer means.

While specific embodiments of the invention have been described in detail, it will be appreciated by those skilled in the art that various modifications and alternatives to those details could be developed in light of the overall teachings of the disclosure. Accordingly, the particular arrangement disclosed are meant to be illustrative only and not limiting as to the scope of the invention which is to be given the full breath of the appended claims and any and all equivalence thereof.

What is claimed is:

1. An external pressure building circuit for a portable cryogenic liquid cylinder, said cylinder having a liquid containing portion and a gas containing portion, said external pressure building circuit comprising:

a tubular member substantially disposed outside of said cylinder having an upper portion and a lower portion;

said upper portion in communication with said gas containing portion of said cryogenic liquid cylinder;

said lower portion in communication with said liquid containing portion of said cryogenic liquid cylinder;

at least one heat exchanger fin coupled to said tubular member extending substantially the entire length of the tubular member; and wherein a portion of said tubular member extends generally vertically.

2. The external pressure building circuit of claim 1, wherein said cryogenic liquid cylinder has an inner container and an outer container, said inner container has a bottom tap; and said lower portion coupled to the bottom tap of said inner container, said lower portion in communication with said liquid containing portion through said bottom tap.

3. The external pressure building circuit of claim 2, wherein said generally vertical portion of said tubular member has an inner diameter between ¾ and 1½ inches.

4. The external pressure building circuit of claim 3 further comprising a plurality of fins coupled to said tubular member, said fins extending approximately one to five inches.

5. The external pressure building circuit of claim 4, further comprising at least four fins coupled to said tubular member adjacent to said vertical portion.

6. The external pressure building circuit of claim 5 wherein said generally vertical portion of said tubular member is between 30 and 60 inches long.

7. A cryogenic liquid cylinder comprising:

an inner container having an upper tap, a bottom tap, a liquid containing portion and a gas containing portion;

an outer container enclosing said inner container;

an insulation means between said inner container and said outer container;

a tubular member extending through said outer container adjacent to said upper tap and coupled to said upper tap, and also extending through said outer container adjacent to said bottom tap and coupled to said bottom tap; and at least one fin coupled to said tubular member extending substantially the entire length of the tubular member.

8. The cryogenic liquid cylinder of claim 7, wherein a portion of said tubular member extends generally vertically.

9. The cryogenic liquid cylinder of claim 8, wherein said generally vertical portion of said tubular member has an inner diameter between ¾ and 1½ inches.

10. The cryogenic liquid cylinder of claim 9 wherein said generally vertical portion of said tubular member is between 30 and 60 inches long.

11. The cryogenic liquid cylinder of claim 10 further comprising a plurality of fins coupled to said tubular member, said fins extending one to five inches.

12. The cryogenic liquid cylinder of claim 11, further comprising at least four fins coupled to said tubular member adjacent to said vertical portion.

13. A cryogenic liquid cylinder comprising:

an inner container having an upper tap, a bottom tap, a liquid portion and a gas portion;

an outer container enclosing said inner container;

an insulation means between said inner container and said outer container;

a tubular member extending through said outer container adjacent to said upper tap and coupled to said upper tap, and extending through said outer container adjacent to said bottom tap and coupled to said bottom tap;

a pallet; and said outer container coupled to said pallet.

14. The cryogenic liquid cylinder of claim 13, wherein said tubular member is disposed above said pallet.

15. The cryogenic liquid cylinder of claim 14, further comprising at least one fin coupled to said tubular member extending substantially the entire length of the tubular member.

16. The cryogenic liquid cylinder of claim 15, wherein a portion of said tubular member extends generally vertically.

17. The cryogenic liquid cylinder of claim 16, wherein said generally vertical portion of said tubular member has an inner diameter between ¾ and 1½ inches.

18. The cryogenic liquid cylinder of claim 17 wherein said generally vertical portion of said tubular member is between 30 and 60 inches long.

19. The cryogenic liquid cylinder of claim 18 further comprising a plurality of fins coupled to said tubular member, said fins extending one to five inches.

20. The cryogenic liquid cylinder of claim 19, further comprising at least four fins coupled to said tubular member adjacent to said vertical portion.

21. A method of supplying a gas to a remote location comprising the steps of:

providing a cryogenic liquid cylinder comprising:

a portable cryogenic liquid cylinder comprising:

an inner container having an upper tap, a bottom tap, a liquid containing portion and a gas containing portion;

an outer container enclosing said inner container;

an insulation means between said inner container and said outer container; and a tubular member extending through said outer container adjacent to said upper tap and coupled to said upper tap, and also extending through said outer container adjacent to said bottom tap and coupled to said bottom tap;

providing a cryogenic liquid within said cylinder;

evaporating a portion of said cryogenic liquid within said tubular member creating a gas;

returning said gas to said inner container;

transferring a portion of said gas from said inner container to an end use.

22. The method of claim 21, comprising the further step of:

allowing said gas to increase the pressure in said inner tank to about 400 p.s.i.

23. The method of claim 22, further comprising the step of transferring gas from the cylinder at a rate of about 2000 cfh.

24. The method of claim 23, further comprising the step of:

evaporating said cryogenic liquid and transferring said gas to said end use until said container is 85% empty of said cryogenic liquid and said gas.

25. The method of claim 23, further comprising the step of:

evaporating said cryogenic liquid and transferring said gas to said end use until said container is 90% empty of said cryogenic liquid and said gas.

26. The cryogenic liquid cylinder of claim 7 wherein said pallet has a surface area about 50% greater than the cross sectional are of said outer container.

* * * * *